US007896981B2

(12) United States Patent
Weber

(10) Patent No.: US 7,896,981 B2
(45) Date of Patent: Mar. 1, 2011

(54) NITRIDING STAINLESS STEEL FOR CONSUMER ELECTRONIC PRODUCTS

(75) Inventor: Douglas Weber, Arcadia, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/755,263

(22) Filed: Apr. 6, 2010

(65) Prior Publication Data

US 2010/0273538 A1 Oct. 28, 2010

Related U.S. Application Data

(60) Provisional application No. 61/173,327, filed on Apr. 28, 2009.

(51) Int. Cl.
*C23C 22/72* (2006.01)
*H04M 1/00* (2006.01)

(52) U.S. Cl. ..... 148/228; 148/318; 455/575.1

(58) Field of Classification Search ..... 148/228, 148/318, 230; 455/575.1
See application file for complete search history.

(56) References Cited

PUBLICATIONS

Marušić et al., "Modification of carbon steel surface by the Tenifer® process of nitrocarburizing and post-oxidation," Surface & Coatings Technology 201 (2006) 3415-3421.

Kolsterising® Corrosion resistant surface hardening of austenitic stainless steel, Bodycote product brochure.

*Primary Examiner*—Roy King
*Assistant Examiner*—Jessee R. Roe
(74) *Attorney, Agent, or Firm*—Beyer Law Group LLP

(57) ABSTRACT

A cost effective system, method and apparatus adapted to provide a nitride layer on stainless steel used for the manufacture of consumer electronic products. In addition to providing a durable, hard surface that is both scratch and impact resistant, the nitride layer allows for the natural surface color and texture of the underlying stainless steel to remain visible to the user. It is this natural surface color and texture of the stainless steel that adds to the aesthetically pleasing appearance of the consumer electronic product thereby enhancing the user's overall experience.

17 Claims, 5 Drawing Sheets

| Type | Properties |
|---|---|
| 301 | Highly ductile, for formed products, hardens rapidly during mechanical working. Good weldability. Better wear resistance and fatigue strength than 304. |
| 302 | same corrosion resistance as 304, with slightly higher strength due to additional carbon |
| 303 | free machining version of 304 via addition of sulfur and phosphorus. Also referred to as "A1" in accordance with ISO 3506 |
| 304 | the most common grade; the classic 18/8 stainless steel. Also referred to as "A2" in accordance with ISO 3506 |
| 304L | same as the 304 grade but contains less carbon to increase weldability. Is slightly weaker than 304 |
| 304LN | same as 304L, but also nitrogen is added to obtain a much higher yield and tensile strength than 304L |
| 308 | used as the filler metal when welding 304 |
| 309 | better temperature resistance than 304, also sometimes used as filler metal when welding dissimilar steels |
| 316 | the second most common grade (after 304); for food and surgical SUS uses; alloy addition of molybdenum prevents specific forms of corrosion. It is also known as marine grade stainless steel due to its increased resistance to chloride corrosion compared to type 304. |
| 347 | similar to 304 but lower risk of weld decay due to addition of titanium. See also 347 with addition of niobium for desensitization during welding |

TABLE 1

300 SERIES—AUSTENITIC CHROMIUM-NICKEL ALLOYS

FIG. 1

| | |
|---|---|
| ◇ | Plasma SUS304 polish+buff |
| □ | Plasma SUS304 only buff |
| △ | Plasma SUS316 polish+buff |
| × | Plasma SUS316 only buff |
| ✱ | Gas SUS304 polish+buff |
| ○ | Gas SUS304 only buff |
| + | Gas SUS316 polish+buff |
| ▭ | Gas SUS316 only buff |

NITRIDING STAINLESS STEEL FOR CONSUMER ELECTRONIC PRODUCTS

CROSS REFERENCE TO RELATED APPLICATIONS

This patent application takes priority under 35 U.S.C. 119 (e) from U.S. Provisional Patent Application Ser. No. 61/173,327 filed Apr. 28, 2009 entitled "NITRIDING STAINLESS STEEL FOR CONSUMER ELECTRONIC PRODUCTS" by Weber that is incorporated by reference in its entirety for all purposes.

TECHNICAL FIELD

The present invention relates generally to personal computing devices, and more particularly to providing an aesthetically appealing, scratch and corrosion resistant nitride layer to consumer electronic products.

BACKGROUND

The stainless steels owe their resistance to corrosion to the presence of chromium. Currently, there is a range of stainless steels from the plain chromium variety to those containing up to six alloying elements in addition to the usual impurities. However, it will be readily appreciated that chromium is the chief alloying element in iron and steel for inhibiting corrosion. This resistance is not due to the inertness of the chromium, for it combines with oxygen with extreme rapidity, but primarily to the oxide so formed that is very thin and stable, continuous and impervious to further attack. Stainless steel is defined as a steel alloy with a minimum of 10% chromium (Cr) content by mass. Stainless steel differs from carbon steel by amount of chromium present. Carbon steel rusts when exposed to air and moisture. This iron oxide film is active and accelerates corrosion by forming more iron oxide. In contrast to ferritic steels, stainless steels have sufficient amount of chromium present so that a passive film of chromium(III) oxide ($Cr_2O_3$) forms within a surface region. It is this film that prevents further surface corrosion and blocks corrosion spreading in the metal's internal structure. There are different types of stainless steels. Austenitic stainless steel is formed when nickel (Ni) is added to the iron melt. In this way, the austenitic structure of iron is stabilized. This austenitic structure makes austenitic stainless steels non-magnetic and therefore less likely to inhibit electromagnetic (EM) activity which can be a significant consideration when used in the manufacture of consumer electronics such as cell phones that utilize RF, Wi Fi, BlueTooth, or other EM based wireless technologies.

Over the years, stainless steels have become firmly established as materials for cooking utensils, fasteners, cutlery, flatware, decorative architectural hardware, and equipment for use in chemical plants, dairy and food-processing plants, health and sanitation applications, petroleum and petrochemical plants, textile plants, and the pharmaceutical and transportation industries. Some of these applications involve exposure to either elevated or cryogenic temperatures; austenitic stainless steels are well suited to either type of service. However, it has now become desirable to use stainless steel in the manufacture of a variety of portable consumer electronic products particularly for the visual impact and structural integrity provided.

However, in order to maintain the look and feel of the stainless steel used in consumer electronics, it is necessary to protect the stainless steel surface from damage that would adversely affect the outward appearance. Furthermore, the protection provided the stainless steel surface must not adversely affect the look and feel of the component.

Therefore, it is desirable to preserve the appearance of consumer electronic products that utilize stainless steel as an aesthetic and structural aspect.

SUMMARY OF THE DESCRIBED EMBODIMENTS

The present invention facilitates the mass production of consistent and aesthetically pleasing nitrided stainless steel components used for consumer electronic products. Such components can be used for a variety of applications, such as to form outer housings for a laptop computer, media players, cell phones or other similar devices. This can be accomplished by providing a variety of manufacturing techniques and features to traditional stainless steel nitriding process typically used for industrial or environmentally challenged (i.e., corrosive) environments not generally encountered in typical consumer applications. In one embodiment, a nitride layer is formed on a stainless steel component used for a consumer electronic product. In the described embodiment, the stainless steel can be austenitic stainless steel where the nitride layer is formed using a salt bath nitride process. The initial nitride layer formed can be at least 15-30 microns thick with a Vickers Hardness (HV) value of at least 1000. In the described embodiment, stainless steel component can be placed in the salt bath at not more than 580 C for a period of time not to exceed approximately 1.5 hours. A finished nitride layer is formed by performing at least one finishing operation on the initial nitride layer. The at least one finishing operation removes at most about 10% of the initial nitride layer.

In another embodiment, a process for preparing a stainless steel housing adapted for assembly of a portable consumer electronic device that includes a plurality of electrical components is described. The process includes at least the following operations, providing a nitrogen based salt bath, heating the nitrogen based salt bath to at least an average temperature of no more than 580° C., placing at least one surface of the stainless steel housing in contact with the nitrogen based salt bath;

removing the stainless steel housing from the nitrogen based salt bath after no more than 90 minutes and no less than 45 minutes, determining a nitride layer thickness of a nitride layer formed on the at least one surface of the housing, and determining a nitride layer hardness. If the thickness is at least 15 microns and the hardness is at least 1000 HV, then polishing the nitride layer to remove no more than about 10% of the nitride layer.

In another embodiment, a portable consumer electronic product is described. The portable consumer electronic product can include at least a plurality of electronic components, a stainless steel housing having a visible exterior surface. The stainless steel housing can provide at least support for most of the plurality of electronic components as well as provide an aesthetic look and feel to a user of the portable consumer electronic product. A nitride layer formed within the surface of the stainless steel housing can have a nitride layer depth of at least 15-30 microns and a Vickers hardness value (HV) of at least 1000.

BRIEF DESCRIPTION OF THE DRAWINGS

The included drawings are for illustrative purposes and serve only to provide examples of possible structures and arrangements for the disclosed embodiments describing systems, methods and apparatus for nitriding stainless steel suitable for consumer electronic products. These drawings in no way limit any changes in form and detail that may be made to the embodiments described herein by one skilled in the art without departing from the spirit and scope of the invention.

FIG. 1 shows a Table 1 describing various types of austenitic stainless steel.

DESCRIPTION OF THE EMBODIMENTS

Figure 2:
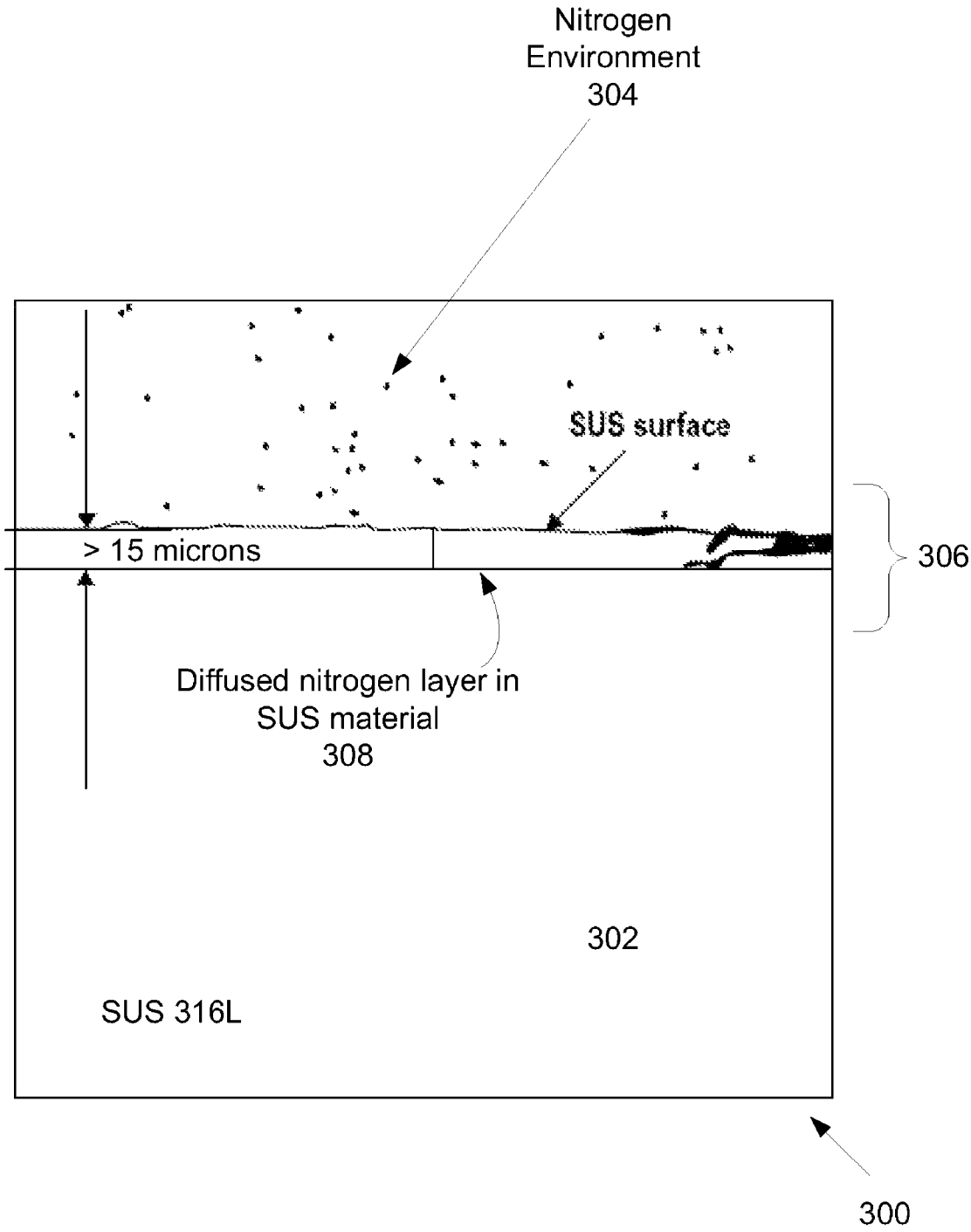
FIG. 2 shows a representative cross section of a sample of type SUS 316L stainless steel.

Reference will now be made in detail to selected embodiments an example of which is illustrated in the accompanying drawings. While described in conjunction with a specific embodiment, it will be understood that the discussion is not intended to be limited to the specific embodiment. To the contrary, it is intended to cover alternatives, modifications, and equivalents as can be included within the spirit and scope of the described embodiments as defined by the appended claims.

The described embodiments relate to a cost effective system, method and apparatus adapted to provide a nitride layer on stainless steel used for the manufacture of consumer electronic products. In addition to providing a durable, hard surface that is both scratch and impact resistant, the nitride layer allows for the natural surface color and texture of the underlying stainless steel to remain visible to the user. It is this natural surface color and texture of the stainless steel that adds to the aesthetically pleasing appearance of the consumer electronic product thereby enhancing the user's overall experience.

The various embodiments described herein pertain to providing a nitride layer on stainless steel components used in the manufacture of consumer electronic products. The stainless steel components can be processed to form an initial nitride layer on at least a portion of the surface of the stainless steel component. The initial nitride layer can be formed using what is referred to as "soft nitriding" (such as the Tufftride™ process) where the stainless steel components are immersed in a salt bath (composed of at least potassium and cyanide salts, for example). Using a salt bath to soft nitride the stainless steel components avoids the high temperatures or other defect inducing mechanisms inherent in plasma nitriding processes and the long processing times required in gas nitriding. Furthermore, the composition of the salt bath can be easily changed to accommodate any changes in the initial nitride layer.

In order to provide the desired appearance, corrosion resistance, scratch and impact resistance, the initial nitride layer can have a depth of at least approximately 15-30 μm. It should be noted, however, that nitride layers have greater or lesser depths can be used depending on the particular application for which it will be used. The initial nitride layer can be formed by immersing the stainless steel components in the salt bath at a temperature of no more than about 580° for no more than about 90 minutes. In this way, the initial nitride layer can have a thickness of approximately 20-30 μm with a Vickers hardness value (HV) in the range of at least 1000.

Once the initial nitride layer is formed, surface defects and impurities can be removed during a finishing process. The finishing process can also be used to smooth out the surface of the nitride layer without substantially affecting the hardness of the initial nitride layer. In the described embodiments, it is anticipated that the finishing process can remove about 10% of the initial nitride layer. For example, if the initial nitride layer is about 20-30 μm, then approximately 2-3 μm can be removed during the finishing process. It should be noted (as seen in Table 3 below) that the hardness of the initial nitride layer remains substantially unchanged through the finishing process. The finishing process can include any number and combination of specific finishing operations. Such finishing operations can include, for example, polishing (either manually or tumbling), buffing, etc. Therefore, once the finishing process is complete, the remaining polished nitride layer can be substantially free of surface defects, having essentially uniform thickness and yet still retain substantially all of the desirable properties (toughness, impact resistance, etc.) present in the initial nitride layer. Furthermore, the finished nitride layer can enhance the appearance of the stainless steel component by allowing the natural sheen of the underlying stainless steel to be seen unobstructed. In this way, the aesthetic appeal of the consumer electronic components can be greatly enhanced while preserving the protective features of the nitride layer.

Since many functions of consumer electronic products rely upon electromagnetic (EM) waves in the radio frequency spectrum (WiFi, Bluetooth, cell phones, for example), it is important that any structural components not be a source of EM interference. Therefore, it is contemplated that a preferred embodiment is directed at using non-magnetic austenitic stainless steels such as SUS 316L (generally described in FIG. 1). It has been determined that nitriding SUS 316L stainless steel provides an optimum combination of corrosion resistance as well as good scratch and impact resistance (Table 2 showing representative SUS 316 compositions suitable for nitriding in the context of the described embodiments). In addition to being non-magnetic, austenitic stainless steel tend to be resistant to corrosion which can be an important consideration in the context of a portable consumer electronic product that can be exposed to salts from a user's hand, the environment in general, or from any other potentially corrosive substance common in everyday experience.

TABLE 2

| | chemical composition ratio (% by weight) | | | | | | | |
|---|---|---|---|---|---|---|---|---|
| material type | C | Si | Mn | P | S | Ni | Cr | Mo |
| SUS316L | <0.03 | 0.75 | <2 | 0.045 | 0.03 | 10-14 | 16-18 | 2-3 |
| SUS316L | 0.009 | 0.61 | 1.23 | 0.035 | 0.002 | 12.15 | 17.33 | 2.05 |
| SUS316L | <0.03 | <1 | <2 | <0.045 | <0.03 | 12-15 | 16-18 | 2-3 |

Since the properties of the nitride layer can vary depending on both the type of stainless steel used and the process by which the nitride layer is formed, it is important that a particular nitride process and associated process parameters be carefully chosen in light of the particular type of stainless steel to be used. For example, for those products where it is contemplated that day to day handling will involve contact with a user's hand or will be used in hot humid environments, then corrosion resistance may be an issue. However, it may be possible that even if corrosion is an issue, it may be less egregious a problem than providing a hard and durable layer to protect against scratches and dents. Selection of the particular nitriding process is intimately tied to those characteristics that the manufacturer deems relevant. Therefore, since the nitride layer can be formed using various nitriding processes and systems that can include, for example, a salt bath process, a plasma process, or a gas nitriding process (box furnace or fluidized bed), the choice of which process to use will be determined by the specific desired properties (i.e., hardness, corrosion resistance, etc.) required for the consumer electronic product usage and expected operating environment.

FIG. 2 shows a representative cross section 300 of a sample 302 of type SUS 316L stainless steel. In order to form a nitride layer (CrN), sample 302 can be placed in nitrogen environment 304. In a thermal diffusion nitriding process (such as gas nitriding and salt bath nitriding described below), nitrogen environment 304 provides a source of nitrogen (N) atoms that have sufficient energy to thermally diffuse (described by Fick's Law) into surface region 306 of sample 302. As the nitrogen atoms diffuse into surface region 306, sufficient energy is lost such that most of the nitrogen atoms combine with Chromium (Cr) atoms present in SUS 316 stainless steel to form a CrN complex (which is actually ceramic in nature) referred to as nitride layer 308. For example, using a gas nitriding process, nitrogen environment 304 can take the form of a nitrogen rich gas usually ammonia ($NH_3$). When ammonia comes into contact with the heated sample 302, the ammonia can disassociate into nitrogen and hydrogen atoms. The nitrogen atoms can then diffuse from the surface of sample 302 into surface region 306 of the SUS 316L stainless steel. It should be noted, however, that times for gas nitriding can be quite long, that is, from about 10 hours to 130 hours.

Another thermal diffusion based nitriding process relies upon a salt bath to provide the requisite nitrogen environment. Using salt bath nitriding, nitrogen environment 304 can take the form of a nitrogen containing salt such as cyanide salt. In the described embodiments, the temperature of the salt bath can range up to about 580° C. It has been determined that at 580° C. the amount of processing time for optimal results provides that the portion of the stainless steel component to be nitrided be in contact with or immersed in the salt bath is no more than 90 minutes.

In contrast to thermal diffusion type nitriding, plasma (ion) nitriding uses plasma-discharge physics. In vacuum, high-voltage electrical energy is used to form a plasma, through which nitrogen ions are accelerated to impinge on the workpiece. This ion bombardment heats the workpiece, cleans the surface, and provides active nitrogen. Plasma nitriding achieves repetitive metallurgical results and complete control of the nitrided layers. Plasma nitriding allows faster nitriding times and the quickly attained surface saturation of the plasma process results in faster diffusion. However, in order to eliminate crystalline damage caused by the energetic ions, the workpiece must undergo an annealing process.

A manufacturer can rely on the nitride layer for many things not the least of which include aesthetic look and feel of the product, scratch and wear resistance, and in some cases extended corrosion resistance. Therefore, depending upon the particular requirements of the manufacturer and the anticipated use/environment which the product will be exposed can influence both the choice of nitriding process to be used (i.e., plasma vs. salt bath vs. nitrogen gas nitriding) and the depth of the finished nitride layer. One characteristic that provides a key factor in such a determination is the hardness of the nitride layer. In general, hardness usually implies a resistance to deformation and for metals the property is a measure of their resistance to permanent or plastic deformation. Hardness can be construed to most likely mean the resistance to indentation as well as an easily measured and specified quantity indicative of the strength and heat treatment of the metal. There are three general types of hardness measurements depending on the manner in which the test is conducted. The three type of hardness measurements are: scratch hardness, indentation hardness, and rebound, or dynamic, hardness. Using scratch hardness, various minerals and other materials are rated on their ability to scratch one another. Scratch hardness is measured according to the Mohs' scale that consists of 10 standard minerals arranged in the order of their ability to be scratched. The softest mineral in this scale is talc (scratch hardness 1), while diamond has a hardness of 10. However, the Mohs' scale is not well suited for metals since the intervals are not widely spaced in the high-hardness range. Most hard metals fall in the Mohs' hardness range of 4 to 8. In dynamic-hardness measurements an object referred to as an indenter is usually dropped onto the metal surface and the hardness is expressed as the energy of impact. The Shore seleroscope (which is the commonest example of a dynamic-hardness tester) measures the hardness in terms of the height of rebound of the indenter.

A more relevant measure of hardness can be determined using the Vickers hardness test. The Vickers hardness test provides a continuous scale of hardness, for a given load, from very soft metals with a DPH of 5 to extremely hard materials with a HV of 1,500 (the Vickers hardness test is described in ASTM Standard E92-72). In practice, the Vickers hardness test uses a square-base diamond pyramid as the indenter (the included angle between opposite faces of the pyramid is 136°). The angle is chosen because it approximates the most desirable ratio of indentation diameter to ball diameter in the Brinell hardness test and due to the shape of the indenter, the Vickers hardness test is frequently referred to as the diamond-pyramid hardness test. The diamond-pyramid hardness number (HV) is defined as the load divided by the surface area of the indentation. In practice, this area is calculated from microscopic measurements of the lengths of the diagonals of the impression. The basic principle, as with all common measures of hardness, is to observe the questioned material's ability to resist plastic deformation from a standard source. The Vickers test can be used for all metals and has one of the widest scales among hardness tests. The unit of hardness given by the test is known as the Vickers Pyramid Number (HV). The HV may be determined from Eq. (1):

$$HV = \frac{L^2}{2P\sin\left(\frac{\theta}{2}\right)} \qquad \text{Eq. (1)}$$

where:

P—applied load, kg

L—average length of diagonal left by the indenter (mm)

θ—angle between opposite faces of diamond (i.e., 136°)

Figure 3:
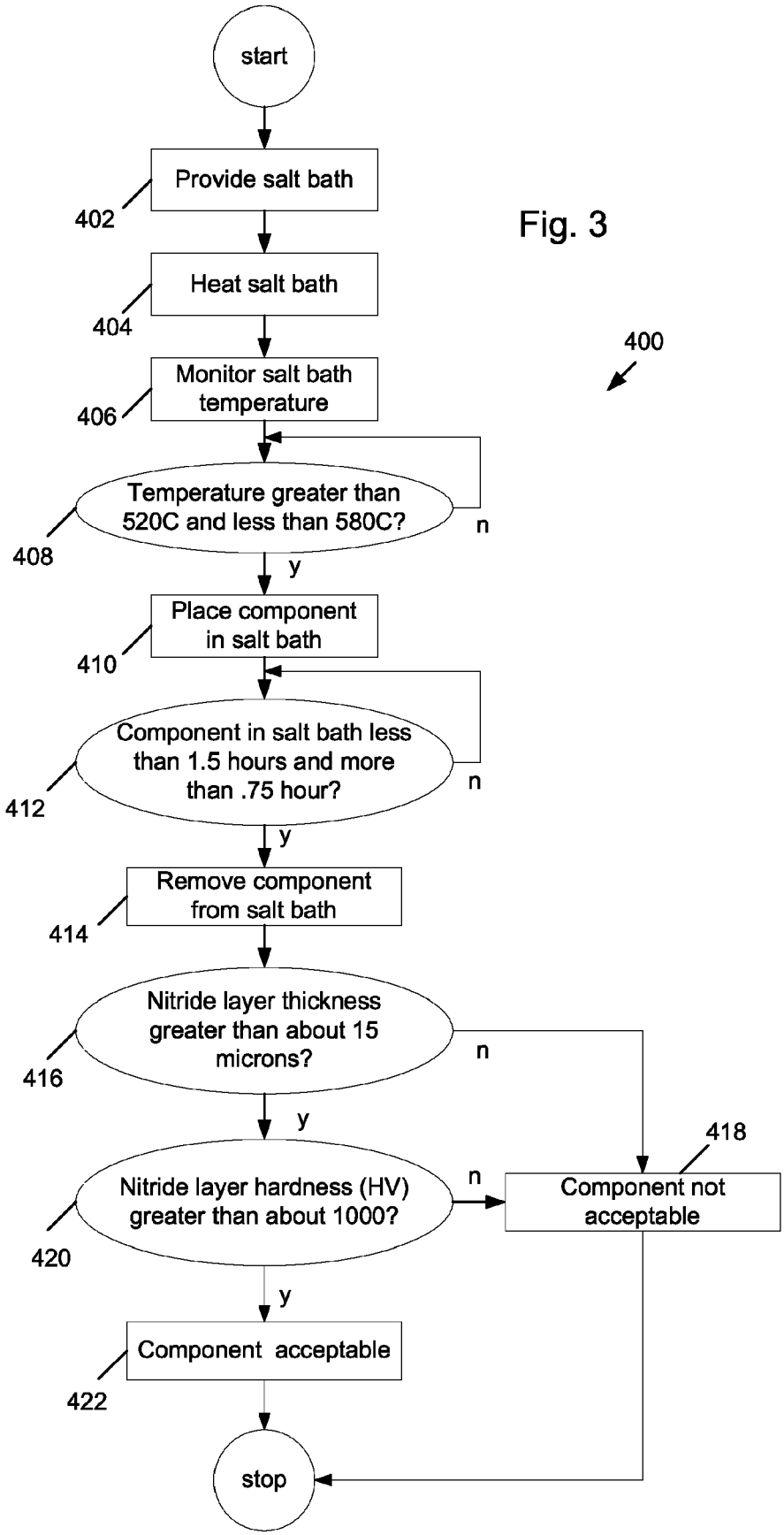
FIG. 3 illustrates a process suitable for forming a nitride layer on a stainless steel (SUS) component used to form a consumer electronic product in accordance with the describe embodiment.

FIG. 3 illustrates a process 400 suitable for forming a nitride layer on a stainless steel (SUS) component used to form a consumer electronic product in accordance with the describe embodiment. In the described embodiment, the stainless steel component can be formed of SUS 304 or 316 or any other appropriate austenitic or ferritic stainless steel. The process 400 can be performed by performing at least the following operations on the stainless steel component to be used in the production of, for example, a portable consumer electronic product. The stainless steel component, also referred to as work piece, can be, for example, a housing used to provide structural support for electronic components located therein. In addition to providing support, the stainless steel housing can provide an aesthetic look and feel that can be protected by and well as enhanced by the presence of a suitable nitride layer formed on an exposed and therefore visible surface. Accordingly, the process 400 can include 402 providing a salt bath that can include, for example cyanide salt. The salt bath is heated at 404 and its temperature monitored at 406 until it is determined at 408 that the salt bath temperature is between at least 520 C and 580 C. Once it is determined that the salt bath has been heated to within the appropriate temperature range, the stainless steel component is placed in the salt bath at 410 for a period of time not more than 1.5 hours and not less than about 0.75 hour at 412. The stainless steel component is removed from the salt bath at 414 after the appropriate length of time has elapsed. If the resulting nitride layer is determined at 416 to have a thickness of less than about 15 microns, then the nitride layer on the component is deemed be not acceptable and rejected at 418 otherwise, if the hardness (using for example a Vickers Hardness Value, HV) of the nitride layer is determined to be approximately about 1000 or higher, then the nitride layer formed on the component is deemed to be acceptable at 422, otherwise it is deemed to be unacceptable and rejected at 418.

Table 3 shows effects of polishing process (i.e., buffing) on hardness values (HV) and nitride layer depth (μm) for samples of austenitic stainless steel nitrided using a salt bath process.

TABLE 3

POST BUFFING AFTER NITRIDING (SALT BATH 580° C. 1.5 H)

| | NO BUFFING | | ONLY BUFFING | |
|---|---|---|---|---|
| MATERIAL | DEPTH (UM) | HARDNESS (HV) | DEPTH (UM) | HARDNESS (HV) |
| SUS316 | 22.1 | 1277 | | |
| SUS316 | | | 20.1 | 1277 |

It should be noted that the hardness value (HV) of the nitride layer remains substantially unchanged at 1277 after completion of the buffing process even though the nitride layer depth has been reduced approximately 10% from 22.1 to 20.1 μm.

Figure 4:
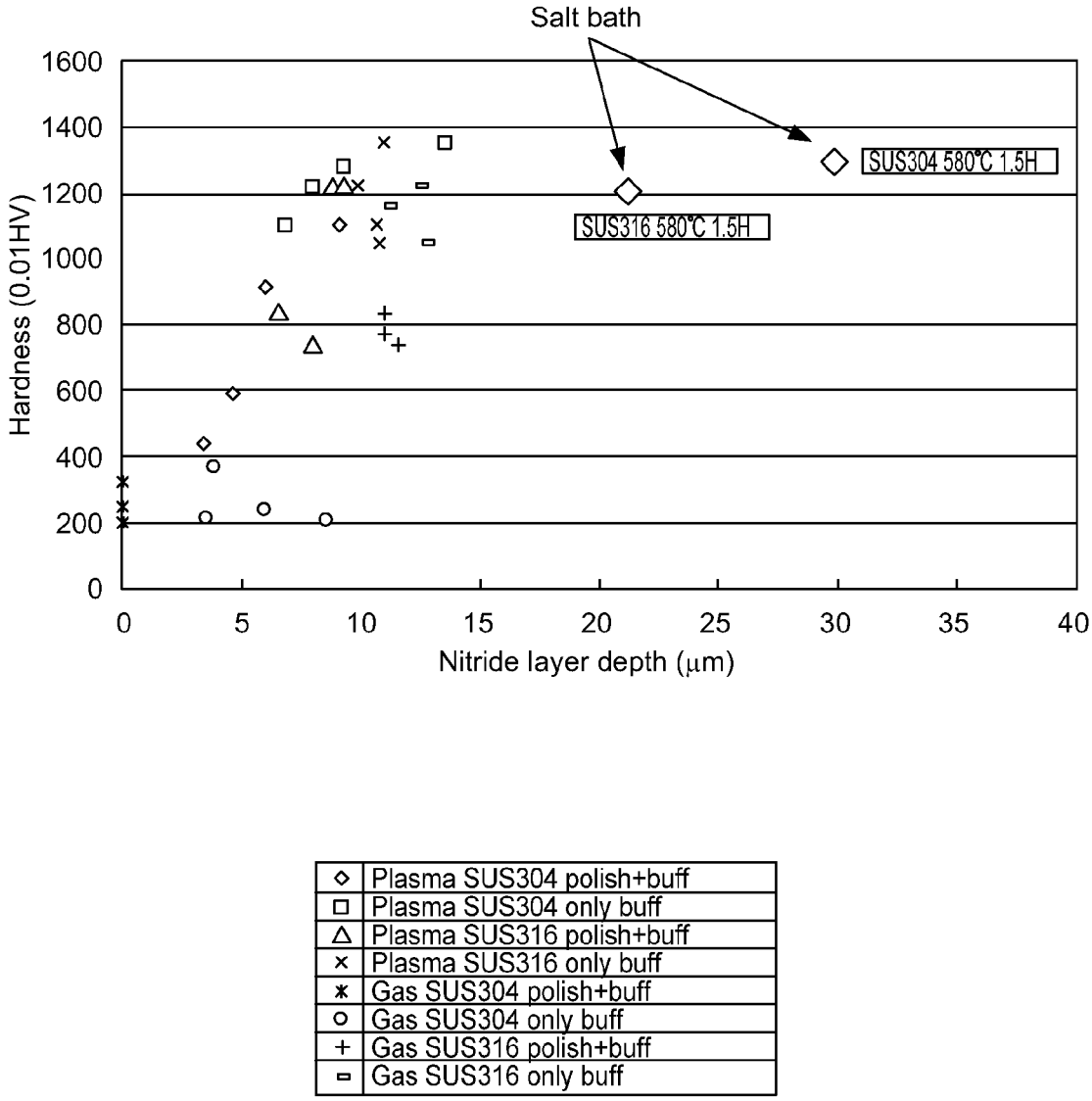
FIG. 4 shows a graphical summary of various evaluation processes including plasma, gas, and salt bath nitriding.

FIG. 4 shows a graphical summary of various evaluation processes including plasma, gas, and salt bath nitriding. As can be readily seen, SUS316 provides an optimal combination of hardness and nitride layer thickness. Furthermore, SUS304 provides a viable alternative to SUS316.

Figure 5:
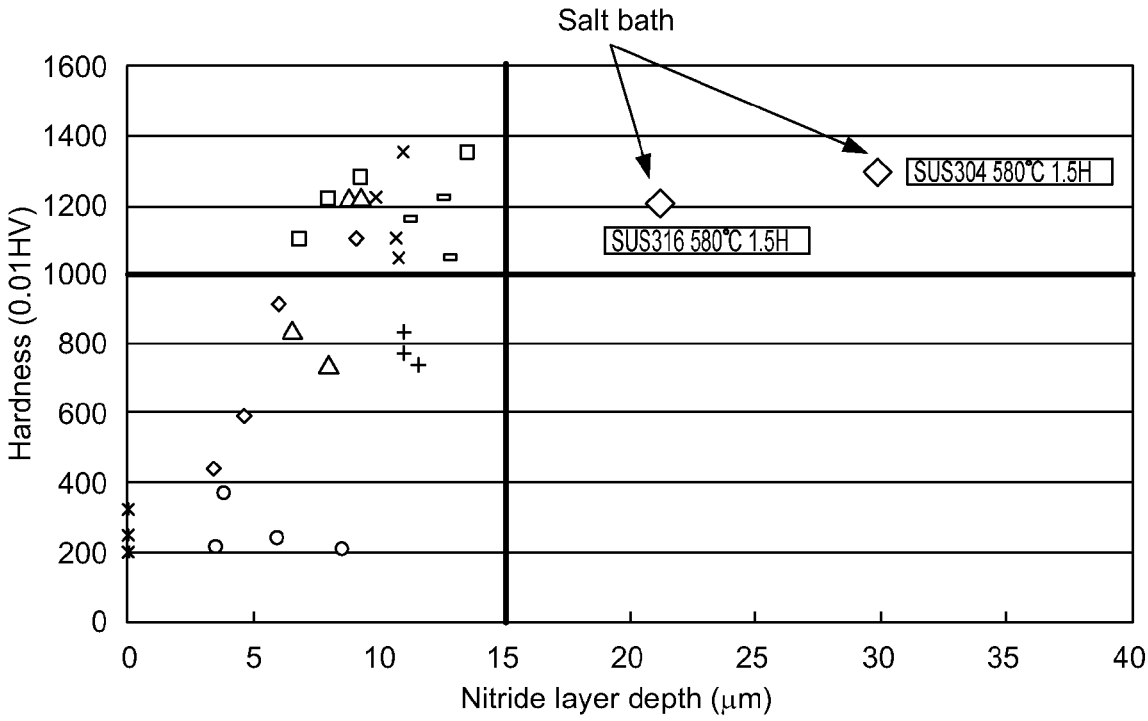
FIG. 5 shows desired hardness and nitride layer depth thresholds overlaying the graphical results shown in FIG. 4.

FIG. 5 shows desired hardness and nitride layer depth thresholds overlaying the graphical results shown in FIG. 4.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A process for providing a nitrided SUS 316L stainless steel component suitable for use in the assembly of a portable consumer electronic product, comprising:

heating a nitrogen based salt bath to an average temperature of no more than 580° C.;

forming an initial nitride layer by, continuously exposing at least a portion of the SUS 316L stainless steel component to the salt bath;

removing the nitrided SUS 316L stainless steel component from the salt bath after no more than 90 minutes has elapsed; and forming a finished nitride layer by performing at least one finishing operation on the initial nitride layer.

2. The process as recited in claim 1, wherein the at least one finishing operation is a polishing operation.

3. The process as recited in claim 1, wherein the at least one finishing operation is a buffing operation.

4. The process as recite in claim 1, wherein the finishing operation removes no more than about 10% of the initial nitride layer.

5. The process as recited in claim 1, wherein the continuously exposing comprises:

immersing the stainless steel component into the salt bath.

6. The process as recited in claim 1, wherein the initial nitride layer is approximately 15-30 μm thick.

7. The process as recited in claim 1, wherein the nitrogen based salt bath includes at least cyanide salt.

8. The process as recited in claims 1, wherein the polishing reduces the thickness of the initial nitride layer by approximately 10%.

9. The process as recited in claim 1, wherein the polished nitride layer has an average Vickers hardness value (HV) of at least approximately 1000.

10. The process as recited in claim 1, further comprising:

wherein the SUS 316L stainless steel component is a stainless steel housing adapted for assembly of a portable consumer electronic device, placing at least one surface of the stainless steel housing in contact with;

the nitrogen based salt bath having the average temperature of no more than 580° C.;

removing the stainless steel housing from the nitrogen based salt bath after no more than 90 minutes and no less than 45 minutes;

determining a nitride layer thickness of a nitride layer formed on the at least one surface of the housing;

determining a nitride layer hardness; and if the thickness is at least 15 microns and the hardness is at least 1000 HV, then polishing the nitride layer.

11. The process as recited in claim 10, wherein the at least one surface of the stainless steel housing is a visible exterior surface.

12. The process as recited in claim 10, wherein the stainless steel housing provides at least support for most of the plurality of electronic components.

13. The process as recited in claim 10, wherein the nitrogen based salt bath includes at least cyanide salt.

14. The process as recited in claim 13, wherein the average salt bath temperature is at least 520 C.

15. The process as recited in claim 10, further comprising:

wherein the portable consumer electronic product comprises at least a plurality of electronic components, and wherein the stainless steel housing provides at least support for most of the plurality of electronic components, and wherein the at least one surface placed in contact with the nitrogen salt bath is a visible exterior surface, and wherein the nitride layer allows a user of the portable consumer product a substantially unobstructed view the visible exterior surface of the stainless steel housing.

16. The process as recited in claim 15, wherein the portable consumer electronic product utilizes RF based communications.

17. The process as recited in claim 15, wherein the portable consumer electronic product is a cell phone.

* * * * *

UNITED STATES PATENT AND TRADEMARK OFFICE

CERTIFICATE OF CORRECTION

PATENT NO. : 7,896,981 B2
APPLICATION NO. : 12/755263
DATED : March 1, 2011
INVENTOR(S) : Douglas Weber It is certified that error appears in the above-identified patent and that said Letters Patent is hereby corrected as shown below:

In column 6, line 4, delete “seleroscope” and insert -- scleroscope --, therefor.

In column 6, line 39, after “(i.e., 136”)” insert -- . --.

In column 8, line 1, in claim 4, delete “recite” and insert -- recited --, therefor.

In column 8, line 11, in claim 8, delete “claims 1,” and insert -- claim 1, --, therefor.

In column 8, line 22, in claim 10, delete “with;” and insert -- with --, therefor.

Signed and Sealed this
Fifteenth Day of November, 2011

David J. Kappos

David J. Kappos
*Director of the United States Patent and Trademark Office*